US009307603B2

(12) United States Patent
Zudrell-Koch

(10) Patent No.: US 9,307,603 B2
(45) Date of Patent: Apr. 5, 2016

(54) PROGRAMMABLE PHASE-CUT DIMMER OPERATION

(71) Applicant: Dialog Semiconductor GmbH, Kirchheim/Teck-Nabern (DE)

(72) Inventor: Stefan Zudrell-Koch, Hohenems (AT)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 14/264,390

(22) Filed: Apr. 29, 2014

(65) Prior Publication Data

US 2015/0028778 A1 Jan. 29, 2015

(30) Foreign Application Priority Data

Jul. 24, 2013 (EP) ..... 13177894

(51) Int. Cl.
*H05B 33/08* (2006.01)

(52) U.S. Cl.
CPC ..... *H05B 33/0851* (2013.01); *H05B 33/0815* (2013.01); *H05B 33/0845* (2013.01); *H05B 33/0896* (2013.01)

(58) Field of Classification Search
CPC ..... H05B 33/0815; H05B 39/04
USPC ..... 315/200
See application file for complete search history.

(56) References Cited

U.S. PATENT DOCUMENTS 8,536,799 B1 * 9/2013 Grisamore et al. ..... 315/294
2004/0255303 A1 * 12/2004 Hogan et al. ..... 719/318
2009/0184662 A1 7/2009 Given et al.
2012/0104851 A1 5/2012 Van Der Veeken et al.
2013/0154496 A1 * 6/2013 Maru et al. ..... 315/210
2013/0262856 A1 * 10/2013 Moshfeghi ..... 713/155
2013/0307434 A1 * 11/2013 Zhang et al. ..... 315/219
2014/0361701 A1 * 12/2014 Siessegger et al. ..... 315/200 R

FOREIGN PATENT DOCUMENTS

CN 101 841 950 9/2010
CN 101841950 A * 9/2010 ..... H05B 37/02

OTHER PUBLICATIONS

European Search Report 13177894.6-1802 Mailed: Feb. 14, 2014, Dialog Semiconductor GmbH.

* cited by examiner

*Primary Examiner* — Douglas W Owens
*Assistant Examiner* — Raymond R Chai
(74) *Attorney, Agent, or Firm* — Saile Ackerman LLC; Stephen B. Ackerman

(57) ABSTRACT

The present document relates to solid state lighting (SSL) devices. A driver circuit for phase-cut dimmable SSL based lighting assemblies is described. A control circuit for a power converter is provided. The power converter is configured to convert an input power derived from a mains power supply into a drive power for a light source. The control circuit comprises a dimmer mode detection unit to determine a first dimmer mode. The first dimmer mode indicates if the input power has been derived from the mains power supply using a dimmer. The control circuit comprises a state processor configured to determine a first operation mode of the power converter. The pre-determined first state information is dependent on the first dimmer mode. The control circuit comprises a first control unit configured to generate a first control signal for operating the power converter in accordance to the first operation mode.

23 Claims, 8 Drawing Sheets

PROGRAMMABLE PHASE-CUT DIMMER OPERATION

TECHNICAL FIELD

The present document relates to solid state lighting (SSL) devices. In particular, the present document relates to a driver circuit for phase-cut dimmable SSL based lighting assemblies.

BACKGROUND

There is a large variety of installed and/or available dimmer models. It is desirable to allow SSL based lighting assemblies (e.g. LED or OLED based lighting assemblies) to be operated in conjunction with the large variety of dimmer models.

SUMMARY

The present document describes a driver circuit and/or a control circuit for SSL based lighting assemblies, which allow for an increased dynamic range and an increased accuracy of dimming of the SSL based lighting assemblies, when being operated in conjunction with a legacy dimmer. According to an aspect, a control circuit for a power converter is described. The control circuit may be implemented as an integrated circuit (IC). The power converter may be configured to convert an input power derived from a mains power supply into a drive power for a light source. The light source may comprise an SSL device (e.g. an LED or OLED array). The mains power supply may be configured to provide an AC power comprising an AC voltage and an AC current at a pre-determined mains frequency (e.g. 50 Hz or 60 Hz). The input power may be derived from or may correspond to the AC power, which has been submitted to a dimmer. In other words, the input power of the power converter may be the output of a phase cut dimmer that modified the voltage of the mains power supply in one of the many known ways, e.g. by cutting the leading or trailing edge of a power cycle. Typically, the dimmer is connected via wiring to a socket where a lighting assembly is mounted. The control circuit and the power converter may form a driver circuit for the light source. The driver circuit and the SSL device may form an SSL based lighting assembly that is connected to a lamp socket.

The power converter may comprise an energy transfer unit configured to provide an intermediate power or voltage based on the input power, and an SSL device driver unit configured to provide the drive power based on the intermediate power. In other words, the power converter may comprise two (or more) power converter stages. Alternatively, the power converter may be a one stage power converter. The energy transfer unit and/or the SSL device driver unit may each comprise a switch mode power converter network comprising at least one power switch. Examples for such switch mode power converter networks are a buck converter network, a buck-boost converter network, a SEPIC (Single-ended primary-inductor converter) network, and/or a flyback network. The use of at least two power converter stages may be beneficial, as the first power converter stage may be used to adapt the operation of the driver circuit for the light source to a type of dimmer that has been used to derive the input power. In other words, the first power converter stage may be used to shield the dimmer dependency of the input power from the light source. The second power converter stage may be used to control the illumination state of the light source, as a function of a dim level which has been determined based on the settings of the dimmer (e.g. based on the phase-cut angle set by the dimmer).

The control circuit may comprise a dimmer mode detection unit configured to determine a first dimmer mode from a plurality of pre-determined dimmer modes, based on one or more sensor signals sensed at corresponding one or more nodes of the power converter. The one or more sensor signals may comprise an input voltage at which the input power is provided. As indicated above, the input power may correspond to an AC power comprising an AC voltage and an AC current. The one or more sensor signals may comprise an input signal indicative of a waveform of the AC voltage. The dimmer mode detection unit may be configured to determine the first dimmer mode based on this input signal. The input signal may be sensed e.g. upstream of a rectifier unit of the driver circuit (which may be located upstream of the energy transfer unit). Alternatively or in addition, the input signal may be sensed downstream of the rectifier unit (and upstream of the energy transfer unit). As such, the input signal may correspond to a rectified AC voltage. The rectifier unit may be configured to perform halfwave or fullwave rectification.

The first dimmer mode may be indicative of whether or not the input power has been derived from the mains power supply using a dimmer. In other words, the first dimmer mode may depend on whether a dimmer has been used in order to modify the mains voltage and may depend on which type of dimmer has been applied. Examples of pre-determined dimmer modes comprise one or more of a mode which indicates that the input power has been derived from the mains power supply without a dimmer; a mode which indicates that the input power has been derived from the mains power supply using a leading edge phase-cut dimmer; a mode which indicates that the input power has been derived from the mains power supply using a tailing edge phase-cut dimmer; and/or a mode which indicates that the input power has been derived from the mains power supply using an intelligent phase-cut dimmer. An intelligent dimmer is a dimer which detects the type of load and operates depending on the detected load as leading or trailing edge.

The control circuit may comprise a state processor configured to determine a first operation mode of the power converter based on pre-determined first state information. The pre-determined first state information may be dependent on the first dimmer mode. In other words, the control circuit may be configured to determine the first operation mode of the power converter (and in particular the operation mode of the energy transfer unit) based on the type of dimmer which has been used to derive the input power. By doing this, the dynamic range and the accuracy of dimming of the light source (e.g. of the SSL device) can be increased.

The control circuit may further comprise a first control unit configured to generate a first control signal (e.g. a PWM signal) for operating the power converter in accordance to the first operation mode. In particular, the first control unit may be configured to generate the first control signal for operating the energy transfer unit in accordance to the first operation mode. In other words, the first control signal may be used for controlling operation of the energy transfer unit. The first control unit may be configured to also generate the first control signal based on one or more sensor signal(s), e.g. a sensor signal indicative of an intermediate voltage at an output of the energy transfer unit. By doing this, the amount of intermediate power (which may be stored in an energy storage unit) may be regulated.

The control circuit may further comprise a storage unit. The storage unit may comprise non-volatile memory, such as OTP memory. The first state information which specifies the first operation mode may be stored in the storage unit. In particular, the storage unit may be configured to store a plurality of dimmer mode tables for the corresponding plurality of pre-determined dimmer modes. Each of the dimmer mode tables may define the operation of the power converter (e.g. the operation of the energy transfer unit) for a particular dimmer mode. By selecting the dimmer mode table which is used to operate the power converter, based on the determined dimmer mode, the operation of the power converter (e.g. the operation of the energy transfer unit) may be adapted to the type of dimmer used to derive the input power.

A first dimmer mode table from the plurality of dimmer mode tables, which corresponds to the first dimmer mode, may be indicative of the first state information for operating the power converter in accordance to the first operation mode. The control circuit may be configured to select the first dimmer mode table (i.e. read it from the storage unit) based on the determined first dimmer mode. Furthermore, the control circuit may be configured to identify the first state information within the first dimmer mode table and provide it to the state processor to determine a first operation mode of the power converter based on pre-determined first state information.

Typically, the first dimmer mode table (as well as the others of the plurality of dimmer mode tables) comprises a plurality of state information records. A first state information record of the plurality of state information records may comprise the first state information defining the first operation mode of the power converter (e.g. of the energy transfer unit).

Typically, each state information record specifies a state (i.e. operation mode) of the power converter. The first operation mode may correspond to a first state (and a first state information record) which comprises the first state information. The first state information may define the first operation mode. The first state information record may be associated with the first state and may further be indicative of one or more future (or subsequent) states, and one or more events which trigger a transition from the first state to the one or more future states. The control circuit may comprise an event detection unit which is configured to detect the occurrence of a first event, based on one or more sensor signals (which may correspond to or which may be different from the one or more sensor signals used to determined the dimmer mode). Furthermore, the state processor may be configured to determine a second state from the one or more future states, based on the detected first event. The second state may identify a second of the plurality of state information records of the first dimmer mode table. The second state information record may comprise second state information defining a second operation mode of the power converter (e.g. of the energy transfer unit). Typically, the second operation mode differs from the first operation mode. In a similar way, a plurality of operation modes may be provided, each operation mode associated with respective state information.

As such, the plurality of state information records of a dimmer mode table may be used to define a state machine for operating the power converter (e.g. the energy transfer unit) according to a plurality of different states. The state machine for operating the power converter in turn may depend on the determined dimmer mode. The different states of a state machine may fulfill different purposes. An example state is an energy transfer state, during which the power converter (e.g. the energy transfer unit) is operated to provide power (e.g. the intermediate power) to an energy storage unit. A further state may be a linear mode state, during which the power converter (e.g. the energy transfer unit) is operated as a load, in order to ensure a reliable firing of the dimmer. When the power converter is operated in the linear mode state, the phase-cut angle which is set by the dimmer may be measured.

During a cycle of the waveform of the input voltage, different states may be selected by the state processor and the first control unit configured accordingly, in order to adapt the operation of the power converter to the waveform of the input voltage. The waveform of the input voltage typically depends on the dimmer which has been used to derive the input voltage. In the present document, it is proposed to provide a plurality of different dimmer mode tables defining a plurality of different state machines for the plurality of different dimmer modes (corresponding to different dimmer types). By doing this, the sequence of states (defined by the state machine) may be adapted to the waveform of the input voltage (which in turn depends on the dimmer mode). This allows enhanced flexibility and increasing the performance of an SSL based lighting assembly, when operated in conjunction with different types of dimmers.

As indicated above, the plurality of dimmer mode tables may be stored in a storage unit. In particular, the dimmer mode tables (and the corresponding state information records) may be stored at different locations within the storage unit. The storage locations of the dimmer mode tables and of the state information records may be identifiable by addresses in the storage unit. It has already been outlined that the state information records may be indicative of one or more future states. In particular, the first state information record may be indicative of the second state. The second state may provide a pointer to the storage location of the second state information record within the storage unit. In other words, the state information records may be indicative of pointers to the storage locations of the one or more state information records corresponding to the one or more future states. By doing this, an efficient means for storing a plurality of state machines within the storage unit is provided.

A state information record may comprise one or more of the following. As already outlined, a state information record may comprise state information which specifies an operation mode of the power converter. Furthermore, a state information record may comprise state machine information which specifies one or more future or subsequent states and one or more events or conditions which trigger a transition from a current state, associated with the state information record, to the one or more future states. In particular, the state machine information may comprise pointers to the storage locations of the one or more state information records corresponding to the one or more subsequent states. In addition, a state information record may comprise masking information which allows an event-triggered transition to be disabled. This may be used to efficiently adapt the state machine for a particular dimmer mode. Furthermore, a state information record may comprise timing information which specifies a time interval for the occurrence of a timeout event. As such the timing information may be used to define one or more events which (only or also) depend on the specified time interval.

The control circuit may comprise a phase-cut angle detection unit configured to determine a dim level based on a phase-cut angle set by the dimmer operating on the mains voltage. The phase-cut angle of the dimmer may be determined based on the waveform of the input voltage derived from the mains voltage. The control circuit, e.g. the state processor in conjunction with the first control unit, may be configured to operate a power switch of the energy transfer unit in a linear operation mode where the energy transfer unit is operated as a load for the mains power supply (in particular for the dimmer) to determine the phase-cut angle set by the dimmer.

The control circuit may comprise a second control unit configured to generate a second control signal (e.g. a PWM signal) based on the dim level for operating the SSL device driver unit to provide the drive power to the light source in accordance to the determined dim level. As such, the SSL device driver unit may be used to control the dim level of the light source. The operation of the second control unit may further depend on the operating mode determined by the state processor. In other words, the second control signal for a particular dim level may depend on the current state of the control circuit. This allows adapting the control signal for the SSL device driver to the different phases that the waveform of the input voltage traverses during a mains power cycle. The states used by the second control unit for generating the second control signal may be the same as the states used by the first control unit. However, first and second control units may use different states, or even a different state machine. In this case, a second state processor may be provided for operating the second state machine and determine the states for controlling the second control unit.

According to a further aspect, a driver circuit for a light source (e.g. for a SSL device) is described. The driver circuit may comprise a power converter and a control circuit as described in this document.

According to another aspect, an SSL based lighting assembly is described. The SSL based lighting assembly may comprise an electrical connection module (e.g. a standardized screw or bayonet base) configured to electrically connect to a mains power supply, thereby providing the input power. In addition, the SSL based lighting assembly may comprise a driver circuit according to any of the aspects outlined in the present document. Furthermore, the SSL based lighting assembly may comprise an SSL device.

According to a further aspect, a method for controlling a power converter is described. The power converter may be configured to convert an input power derived from a mains power supply into a drive power for a light source. The method may comprise determining a first dimmer mode from a plurality of pre-determined dimmer modes, based on one or more sensor signals sensed at corresponding one or more nodes of the power converter. The one or more nodes of the power converter may correspond to a node upstream of a rectifier unit, to a node downstream of the rectifier unit and upstream of an energy transfer unit, to a node downstream of the energy transfer unit and upstream of an SSL device driver unit, and/or to a node downstream of the SSL device driver unit and upstream of the SSL device. The first dimmer mode may be indicative of whether or not the input power has been derived from the mains power supply using a dimmer.

The method may further comprise determining a first operation mode of the power converter based on pre-determined first state information. The pre-determined first state information may be dependent on the first dimmer mode. In addition, the method may comprise generating a first control signal for operating the power converter in accordance to the first operation mode.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

Figure 1:
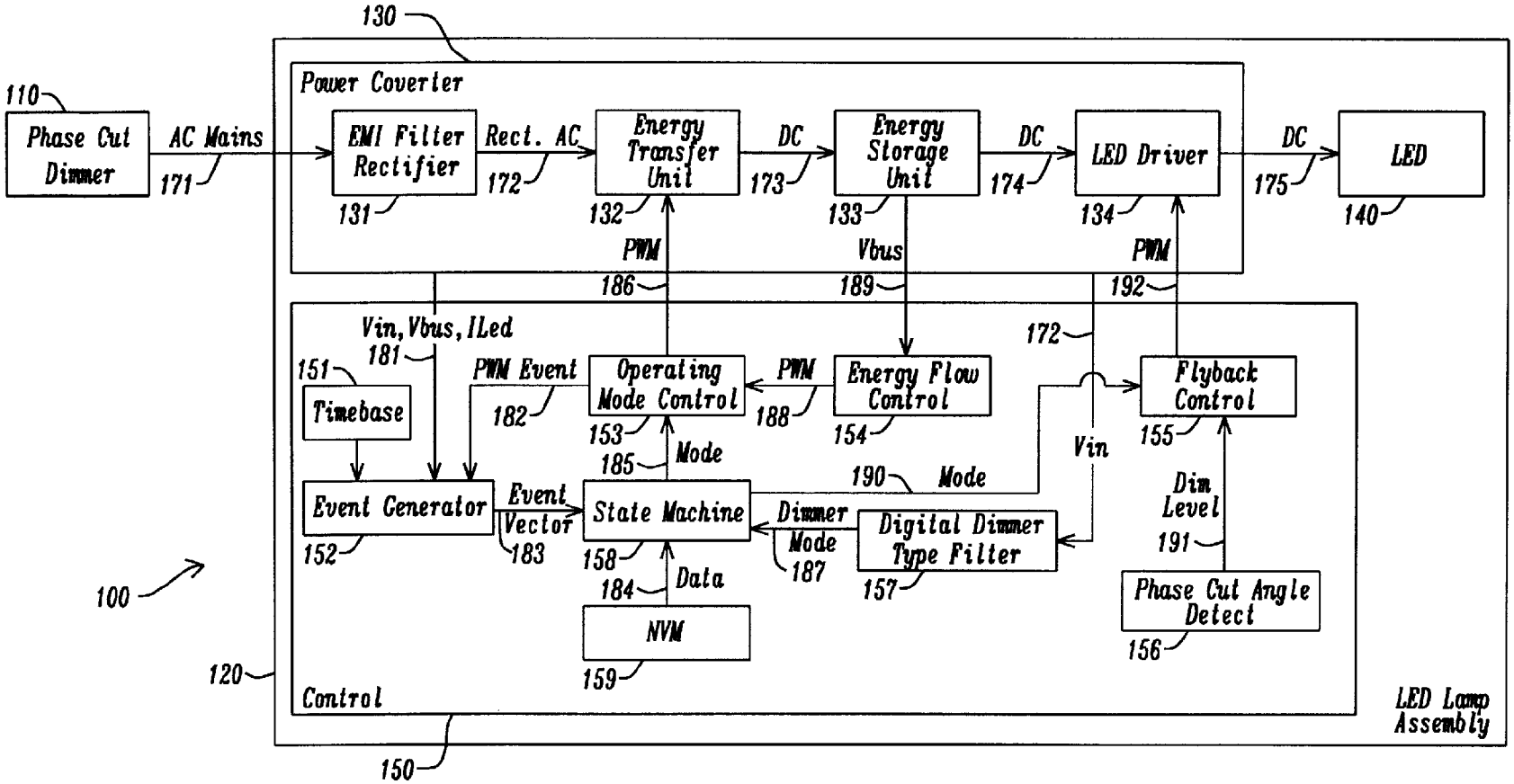
FIG. 1 illustrates a block diagram of an example SSL based lighting assembly.

As outlined above, the present document addresses the technical problem of providing an SSL based lighting assembly with an increased dimming performance. Driver ICs (integrated circuits) for phase-cut dimmable SSL (e.g. LED) retrofit lamps may be implemented with one specific algorithm to control the operation of the driver when applied to edge phase-cut dimmers. The dimmer control schemes may be defined in datasheets of the driver IC.

The present document solves the technical problem of providing an SSL device with an increased dimming performance, by providing a driver circuit and/or a control circuit which is configured to adjust its control algorithm to a particular dimmer configuration. The control algorithms may be further dependent on the configuration of an energy transfer unit comprised within the driver circuit, e.g. the energy transfer unit may comprise a single stage or a dual stage power converter. In other words, it is proposed in the present document to provide a control circuit for SSL based lighting devices, wherein the control circuit comprises a dimmer control algorithm which is changeable and programmable. By doing this, the designer of a driver circuit has means to adapt the driver circuit to various different configurations of the driver circuit (e.g. to different configurations of the energy transfer units) and/or to various different configurations of the dimmer.

In order to allow for a flexible adaption of the SSL control to different dimmer configurations, it may be beneficial to split the overall SSL control into different components, e.g. into a dimmer control component and into a SSL (e.g. LED)

control component. The SSL control component may be separated from the dimmer control component. By way of example, the dimmer control component may be directed at detecting a phase-cut angle. The detected phase-cut angle may be passed to the SSL control component, which controls the SSL device based on the detected phase-cut angle. As such, the dimmer control algorithm (for controlling the SSL device of the SSL based lighting assembly) and the phase-cut dimming detection may be separated.

The dimmer control component may be configured to detect the type of dimmer which is used to control the illumination level of the SSL based lighting assembly. The dimmer type detection, may be performed at system startup or during normal operation. Dimmer detection may be done based on discrete filtering of the mains input voltage under defined load conditions.

As such, the present document is directed at the optimization of SSL based lighting assemblies with regards to phase-cut dimmer compatibility. The adaptability of the control algorithms used for driving SSL devices allows for an increased flexibility for designing new SSL based lighting assemblies. In addition, the cost of SSL based lighting assemblies may be reduced by providing a control circuit which is configured to support different power topology and/or which is configured to operate in conjunction with different dimmer types.

The control circuit which is described in the present document allows the current through the one or more power switches (e.g. the MOSFETs) of the energy transfer unit of a SSL device driver circuit to be digitally controlled. The control circuit may make use of an embedded OTP (one time programmable memory) or another type of nonvolatile memory technology, which is used to store the adjustable control algorithm in an efficient manner. The control circuit may comprise a programmable state machine architecture as described in the present document. Furthermore, the control circuit may be configured to operate the one or more power switches of a primary (or first) stage of the energy transfer unit in different operation modes. In particular, the one or more power switches may be operated in a switching mode (e.g. for providing for power conversion) and/or in a linear mode (e.g. for allowing for measurement of the phase-cut angle). Within the switching mode different PWM (Pulse Width Modulation) modes may be implemented (e.g. CCM (Continuous Conduction Mode), DCM (Discontinuous Conduction Mode) and/or BCM (Boundary Conduction Mode)).

In the present document a light bulb "assembly", e.g. LED Lamp assembly, includes all of the components required to replace a traditional incandescent filament-based light bulb, notably light bulbs for connection to the standard electricity supply. In British English (and in the present document), this electricity supply is referred to as "mains" electricity, whilst in US English, this supply is typically referred to as power line. Other terms include AC power, line power, domestic power and grid power. It is to be understood that these terms are readily interchangeable, and carry the same meaning. Moreover, the particular configuration of the radiated light at a given point in time of the light source is referred to as the illumination state.

Typically, in Europe electricity is supplied at 230-240 VAC, at 50 Hz and in North America at 110-120 VAC at 60 Hz. The principles set out in the present document apply to any suitable electricity supply, including the mains/power line mentioned, and a DC power supply, and a rectified AC power supply.

A typical light bulb assembly comprises a bulb housing and a base including an electrical connection module. The base can be of a screw type or of a bayonet type, or of any other suitable connection to a light bulb socket. Typical examples for standardized bases are the E11, E14 and E27 screw types of Europe and the E12, E17 and E26 screw types of North America. Furthermore, a light source (also referred to as an illuminant) is provided within the housing. Examples for such light sources are a CFL tube or a solid state light source, such as a light emitting diode (LED) or an organic light emitting diode (OLED) (the latter technology is referred to as solid state lighting, SSL). The light source may be provided by a single light emitting device, or by a plurality of LEDs. A driver circuit is located within the bulb housing and serves to convert supply electricity received through the electrical connection module into a controlled drive current for the light source. In the case of a solid state light source, the driver circuit is configured to provide a controlled direct drive current to the light source.

The housing provides a suitably robust enclosure for the light source and drive components, and includes optical elements that may be required for providing the desired output light from the assembly. The housing may also provide a heat-sink capability, since management of the temperature of the light source may be important in maximizing light output and light source life. Accordingly, the housing is typically designed to enable heat generated by the light source to be conducted away from the light source, and out of the assembly as a whole.

In the following, methods and systems will be described in the context of LED lamps. It should be noted, however, that the methods and systems described herein are equally applicable to controlling the power provided to other types of illumination technologies such as other types of SSL based lamps (e.g. OLEDs).

FIG. 1 shows a block diagram of an example system 100 comprising a phase-cut dimmer 110 and an SSL based lighting assembly 120. The lighting assembly 120 receives a (phase-cut) AC mains voltage and/or current and/or power 171 from the mains supply. The lighting assembly 120 (or short assembly) comprises a power converter 130 which is configured to convert the AC mains power 171 into a DC drive power 175 for the SSL device 140 (e.g. an LED or OLED array). The power converter 130 is controlled using the control circuit 150.

The power converter 130 comprises an EMI (Electro Magnetic Interference) circuit and a rectifier circuit 131, configured to provide a rectified AC voltage/current/power 172. Furthermore, the power converter 130 comprises an energy transfer unit 132 (comprising e.g. a DC-to-DC power converter) configured to provide an intermediate voltage/current/power 173 (also referred to as the bus voltage/current/power). The intermediate power 173 may be provided to and stored within an energy storage unit 133 (comprising e.g. a capacitor). Furthermore, the intermediate power 174 may be provided to an SSL driver unit 134 (comprising e.g. a DC-to-DC power converter), configured to provide the DC drive voltage/current/power 175 to the SSL device 140, and to thereby control the illumination level of the SSL device 140.

The power converter 130, in particular the energy transfer unit 132 (e.g. the first stage of the power converter 130) and the SSL driver unit 134 (e.g. the second stage of the power converter 130), may be controlled using the control circuit 150 which may be implemented as an integrated circuit (IC). The control circuit 150 may comprise a timebase unit 151 configured to provide a clock signal which may be used for timing/synchronization purposes (e.g. for synchronization to the cycles of the AC mains voltage 171). Furthermore, the control circuit 150 may comprise an event generator unit 152 configured to detect and/or generate one or more events 183 which may trigger a transition from a first state (e.g. a current state) to a second state (e.g. a future state) of the assembly 120. The states may relate e.g. to illumination states. The one or more events 183 may be determined and/or generated based on one or more sensor signals 181. The one or more sensor signals 181 may comprise the AC mains voltage 171 (also referred to as the input voltage Vin), the rectified AC voltage 172, the bus voltage 173 and/or the SSL drive voltage 175. The bus voltage 173 may correspond to the voltage across the energy storage unit 133 (e.g. across the capacitor of the energy storage unit 133). Furthermore, the one or more events 183 may be determined based on a PWM event 182 derived from the first PWM signal 186 which is used to control the operation of the energy transfer unit 132.

The first PWM signal 186 may be determined using a state machine unit 158 (also referred to as the state machine 158) which is configured to determine an operation mode 185 (also referred to as an operation state) of the energy transfer unit 132, based on state data 184 stored in a storage unit 159, based on the one or more events 183 (also referred to as an event vector) and/or based on a dimmer type 187 (i.e. based on the type of the dimmer 110). The dimmer type 187 may be determined using a dimmer type detection unit 157 (labeled as digital dimmer type filter). The dimmer type 187 may be determined e.g. based on an analysis of the input voltage Vin 171. The state machine unit 158 may generate a corresponding memory address for storage unit 159 to access the state data 184 for current operating state 185. Since the operation mode 185 and its corresponding state data 184 may depend on the dimmer type 187, the state data address is generated based on the dimmer type 187, i.e. each type of dimmer has separate state data stored in the storage unit 159.

The state machine unit 158 may determine the operation mode 185 using a pre-determined state machine which defines a plurality of different operation modes and a plurality of transitions between the plurality of different operation modes. Furthermore, the state machine defines the events 183 which trigger respective transitions between respective operation modes. The operation mode 185 is used by an operation mode control unit 153 to determine the first PWM signal 186. By way of example, a switched operation mode 185 may comprise a switched operation of a power switch of the energy transfer unit 132 and the first PWM signal 186 may trigger the on-states and off-states of the power switch. In another example, a linear operation mode 185 may comprise the operation of the power switch of the energy transfer unit 132 in a linear mode. In this case the first PWM signal 186 may trigger the desired operation of the power switch.

The operation mode control unit 153 may be configured to determine the first PWM signal 186 using a feedback mechanism by feeding back the bus voltage 189. In particular, an energy flow control unit 154 may determine the energy at the output of the energy transfer unit 132 based on the bus voltage 189 and provide a feedback signal 188, which is indicative of the energy at the output of the energy transfer unit 132, to the operation mode control unit 153.

The control circuit 150 may be configured to generate a second PWM signal 192 for controlling the SSL driver unit 134. In particular, the control circuit 150 may comprise an angle detection unit 156 configured to detect the phase-cut angle which is set by the dimmer 110, and configured to determine a dim level 191 based on the detected phase-cut angle. Furthermore, the control circuit 150 comprises a driver control unit 155 (labeled as flyback control) configured to generate the second PWM signal 192 based on the dim level 191.

In embodiments, the driver control unit 155 may generate the second PWM signal 192 based on the dim level 191 and on an operating state 190 as determined by the state machine 158. This allows separate control of the SSL driver unit 134 for different states defined for different sections of the input waveform during a mains cycle. For example, during a time interval where the input waveform has been cut by a phase cut dimmer, the second PWM signal 192 for the SSL driver unit 134 may be different than for a time interval where the input waveform has not been cut and carries power to the system 100. In particular, this allows, e.g., to reduce (or even shut off) power supplied to the SSL device 140 during times where no power is supplied by the input voltage (e.g. by reducing the PWM duty cycle). In embodiments, the power switch of the energy transfer unit 132 is operated in a linear mode during such times where no power is supplied by the input voltage, thereby providing a defined load for the dimmer which facilitates measuring the exact phase cut angle because false firing of the dimmer is prevented. The state 190 supplied to the driver control unit 155 may be identical or different to the state 185 supplied to the operating mode control unit 153.

As such, the lighting assembly 120 (e.g. the LED lamp assembly) of FIG. 1 comprises three parts: the power conversion part (comprising passive components and active switches) 130, the control part (also referred to as the driver IC) 150 and the SSL device 140.

The energy transfer unit 132 is a module which typically comprises passive components and a power switch. By way of example, the energy transfer unit 132 may comprise or exhibit a standard switch mode power supply topology (boost topology, SEPIC topology, flyback topology, etc.). Alternatively, the energy transfer unit 132 may comprise a switch/diode combination which links the input of the energy transfer unit 132 and the output of the energy transfer unit 132 as a function of the switch control. Alternatively the energy transfer unit 132 comprises only a power switch operation in parallel to the LED driver. As indicated above, the power switch of the energy transfer unit 132 may be operated in different modes, e.g. a fixed-on mode, a fixed-off mode, a PWM switching mode (as influences by the energy flow control unit 154), a linear current mode, other switching modulation schemes, etc.

The operation mode of the energy transfer unit 132 may be controlled by the respective operating mode control unit 153 of the control circuit 150. The operation mode control unit 153 also ensures that the transition between different operation modes takes place in a safe manner (e.g. to protect the assembly 120 from excessive transients). The operating mode control unit 153 may receive mode information 185 from the state machine unit 158, which itself may be driven by an event vector 183 and memory information 184 provided by the storage unit 159 (comprising e.g. non-volatile memory).

The event generator unit 152 may receive timing information and sensor signals 181 from various nodes within the lighting assembly 120. In each state, the state machine unit 158 may receive masking information from the storage unit 159, as well as information for the next state depending on the event vector 183 and depending on event masking (which may be used for the exclusion of one or more event). Each assertion of an unmasked event may trigger a state transition. The storage unit 159 may be implemented as OTP, MTP, EEProm, Fuses etc.

Figure 2:
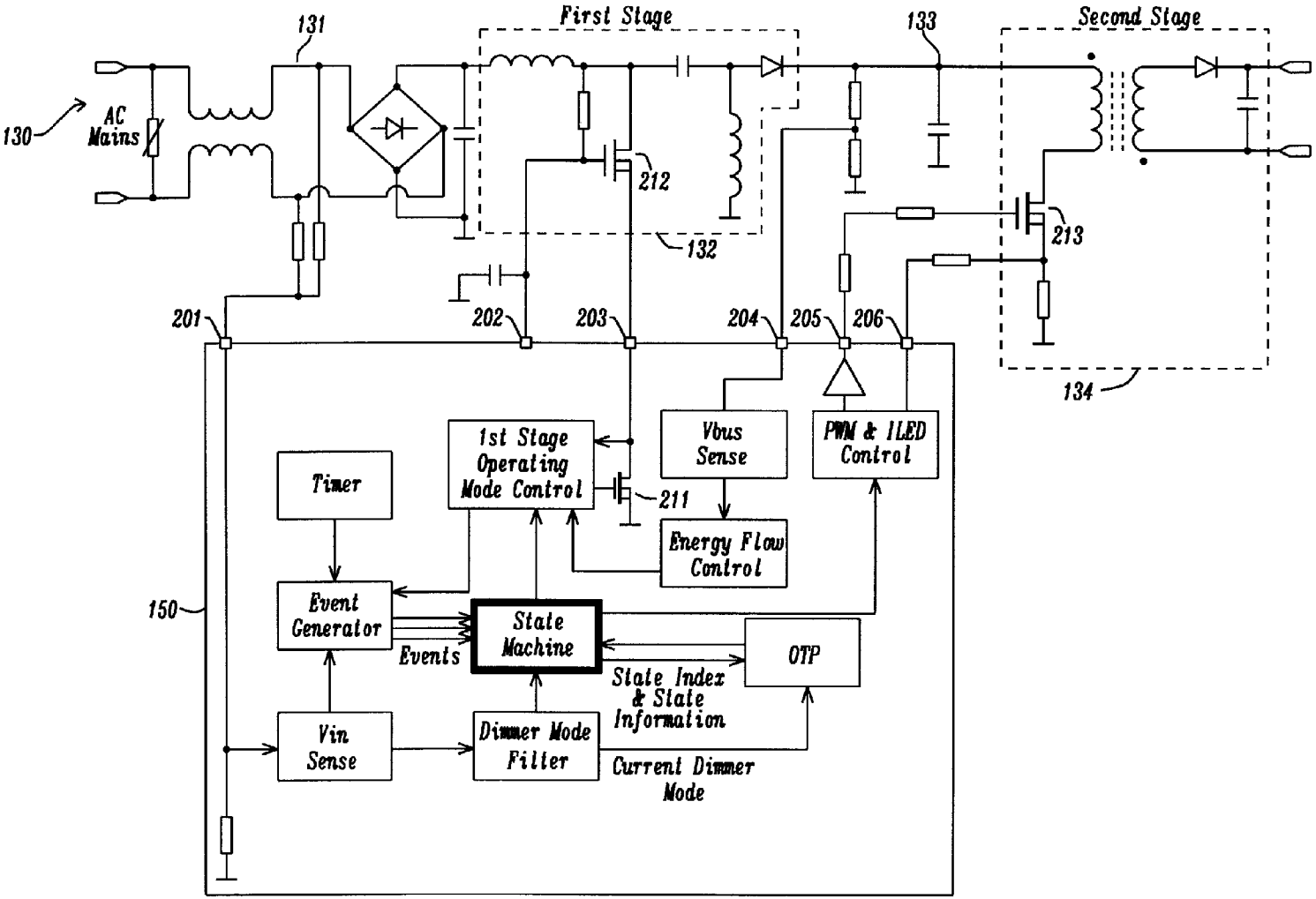
FIG. 2 shows a circuit diagram of an example SSL based lighting assembly.

FIG. 2 shows a more detailed example of a power converter 130 used in conjunction with a control circuit 150. In particular, an example for detailed topologies of the energy transfer unit 132 and of the SSL driver unit 134 are shown. In the illustrated example, the energy transfer unit 132 comprises a power switch 212 which is source controlled using a control switch 211 within the control circuit 150. The source of the power switch 212 is coupled to the control switch 211 via the first control pin 203 of the control circuit 150. Furthermore, the SSL driver unit 134 comprises a power switch 213 which is gate controlled via the second control pin 205. Furthermore, the control circuit 150 may comprise an input voltage measurement pin 201 for measuring the input voltage 171, a supply voltage pin 202 for sensing the supply voltage to the gate of the power switch 212, a bus voltage measurement pin 204 for sensing the bus voltage 173 and/or a current measurement pin 206 for sensing the current through the power switch 213.

Example events 183 which are determined or generated by the event generator unit 152 are the input voltage 171 crossing a pre-determined threshold and/or the bus voltage 173 crossing a pre-determined threshold, a timeout (detected by the timebase unit 151), the reaching of a pre-determined phase counter, the start of operation of the power converter 130, etc.

Figure 3A:
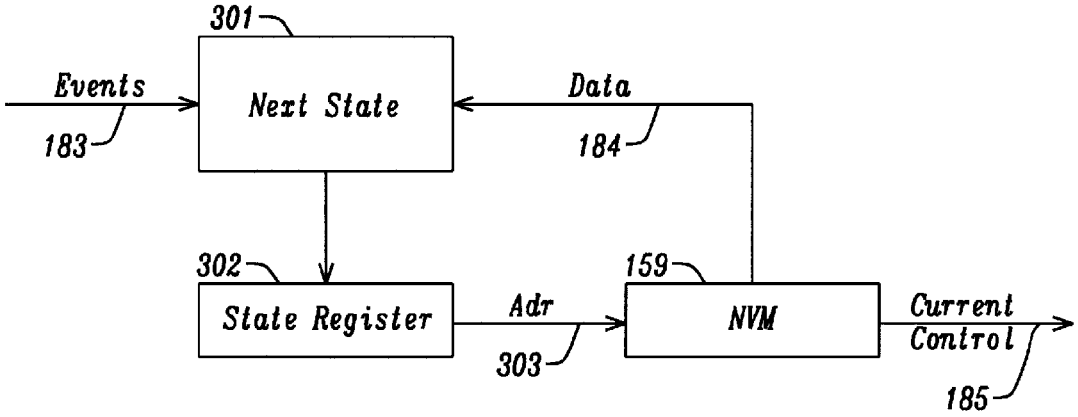
FIGS. 3*a* and 3*b* show example state machine implementations.

FIG. 3*a* shows an example of a state machine topology, which may be implemented in the control circuit 150 (e.g. within the state machine unit 158). The determination or detection of an event 183 may trigger the transition to a new or next state 301. The new state 301 may be translated into an address 303 using a state register 302. The address 303 may point to a particular memory unit within the storage unit 159. The storage unit 159 may comprise control information 185 associated with the new state 301. Furthermore, the storage unit 159 may comprise data 184 regarding transitions which lead away from the new state 301.

Figure 3B:
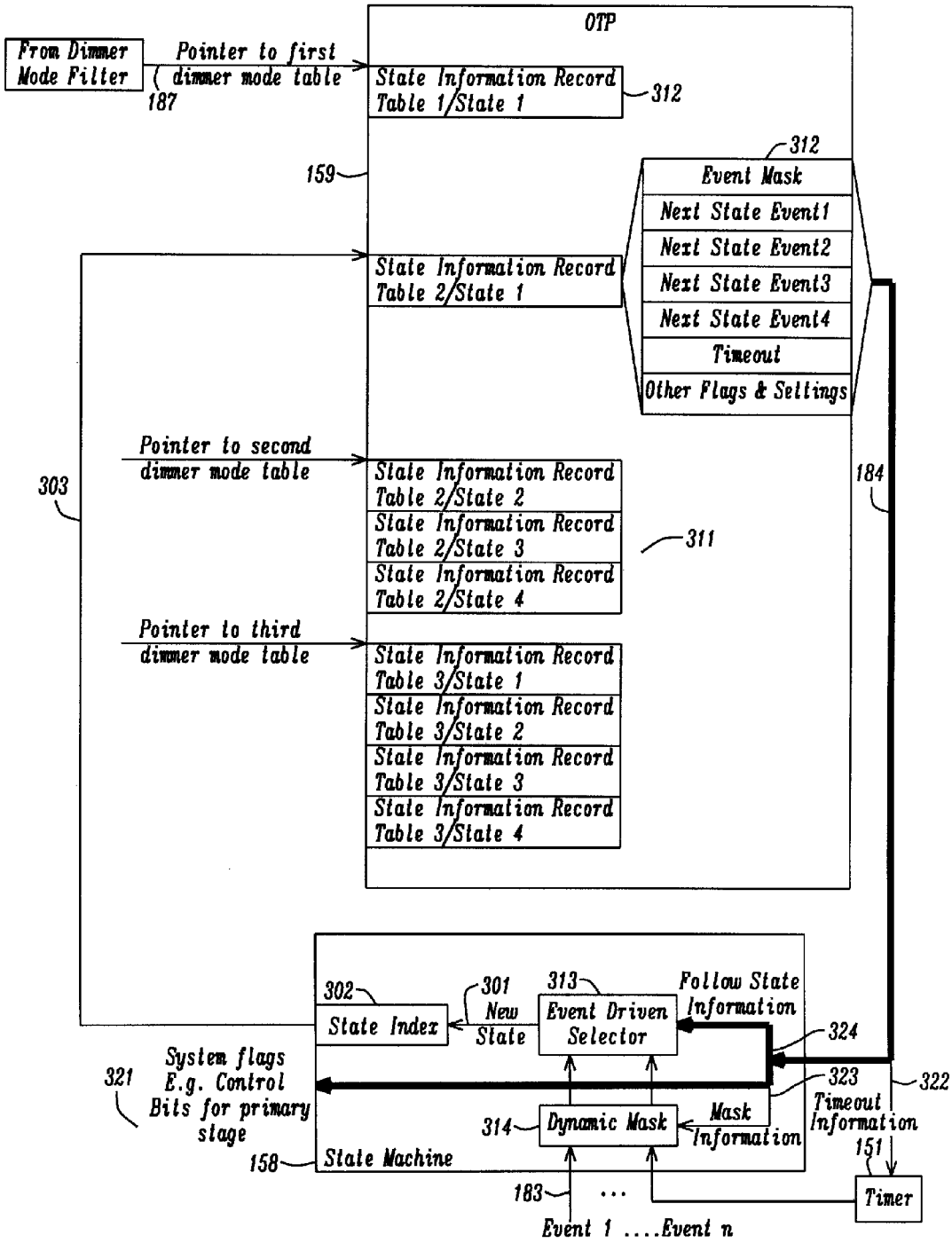

FIG. 3*b* shows an example state machine in further detail. The storage unit 159 may comprise a plurality of dimmer mode tables 311 for a plurality of different dimmer modes. The dimmer type detection unit 157 may be configured to determine a dimmer mode or dimmer type 187 (e.g. based on the input voltage Vin 171). The determined dimmer mode or dimmer type 187 may be used to select a corresponding dimmer mode table 311 within the storage unit 159. Each dimmer mode table 311 may comprise a plurality of state information records 312 which define a state machine for the corresponding dimmer mode 187. As such, each dimmer mode table 311 may comprise information which defines the state machine which is to be used for operating the lighting assembly 120 in conjunction with the respective dimmer mode 187.

In the illustrated example, a state information record 312 comprises an event mask which may be used to block or allow particular events 183. Furthermore, the state information record 312 identifies one or more next states 301 and the events which trigger the transition to the one or more next states 301. Furthermore, the state information record 312 may comprise timeout information, as well as further flags and settings which may be used for the control of the energy transfer unit 132 within the state which is associated with the state information record 312. The information comprised within a particular state information record 312 may be passed as data 184 to the state machine unit 158, when the lighting assembly 120 is operated in the corresponding particular state. The timeout information 322 may be passed to the timebase unit 151, the event mask information 323 may be passed to a masking unit 314, the flag&settings information 321 may be passed to the operating mode control unit 153 and the next state information 324 may be passed to the state selector 313. The state selector 313 may determine the next state 301 subject to the detection of a particular event 183 (wherein the masking unit 314 may be used to block one or more of the events 183). Once a next state 301 has been determined, the state register 302 may be used to identify the address 303 of the state information record 312 which corresponds to the next state 301.

The state machine architecture of FIG. 3*b* provides a cost efficient and flexible means for adapting the lighting assembly 120 to various different types of dimmers. In particular, by determining a plurality of different dimmer mode tables 311, the lighting assembly 120 may be enabled to work in conjunction with dimmers 110 of different dimmer types.

The dimmer type detection unit 157 (also referred to as dimmer type filter block or dimmer mode filter) may make use of a digital filter which takes samples of a signal related to the mains input 171, in order to determine the dimmer mode 187, e.g. in order to determine the type of the dimmer 110. Examples for dimmer modes are: leading edge dimmer, trailing edge dimmer, no dimmer being used, and intelligent dimmer being used. The control unit 150 and in particular the storage unit 159 may comprise a corresponding dimmer mode table 311 for each of the above mentioned dimmer modes 187.

As outlined above, each dimmer mode table 311 may comprise a plurality of state information records 312, wherein each state information record 312 defines a corresponding state of the lighting assembly 120. A state information record 312 may comprise some or all of the following state information: information 324 regarding one or more successor states 301 and the one or more events 183 which trigger the transition to the one or more successor states 301, an event mask 323, timeout information 322, other information and/or configuration flags 321. Each state information record 312 may fully represent the functionality of this particular state, e.g. as a function of the incoming events. Using the event mask, events may be enabled and/or disabled within the corresponding state. Using the timeout information a state may be assigned a timeout value. One the timeout value is reached, at transition to a default state may be triggered. The other bits of information 321 may be used to configure the lighting assembly 120. For example, the other bits of information 321 may be used to control the mode of operation 185 of the energy transfer unit 132. As already indicated above, the operation modes 185 may comprise a switch mode with regulated energy transfer, a switch mode without regulated energy transfer, a linear mode at a particular current, an on/off mode, etc.

The state index 302 is typically as a register which holds a pointer 303 to the current state, i.e. to the state information record 312 of the current state. This may be a relative address within a particular dimmer mode table 311. As indicated above, different tables 311 may be used for different dimmer modes 187, such as a "no dimmer" mode, a "leading edge dimmer" mode, and/or a "tailing edge dimmer" mode.

The state information record 312 to which the current state index 303 is pointing is applied to the input of the state machine unit 158, where the state information record 312 is decoded and where the information comprised within the record 312 is split up into the several information parts such as timeout information 322, mask information 323 and/or information 324 regarding subsequent states and the events which trigger the transition to the subsequent states. The event driven selector 313 may determine the following state 301. If a plurality of events have occurred during a particular clock cycle (monitored by the timebase unit 151), the selector 313 may be configured to determine the event of the plurality of detected events with the highest priority. This determined event may be the event which triggers the transition to the next state 301. Subsequent to the determination of a next state 301, the associated state information record 312 is determined, and so on.

Figure 4:
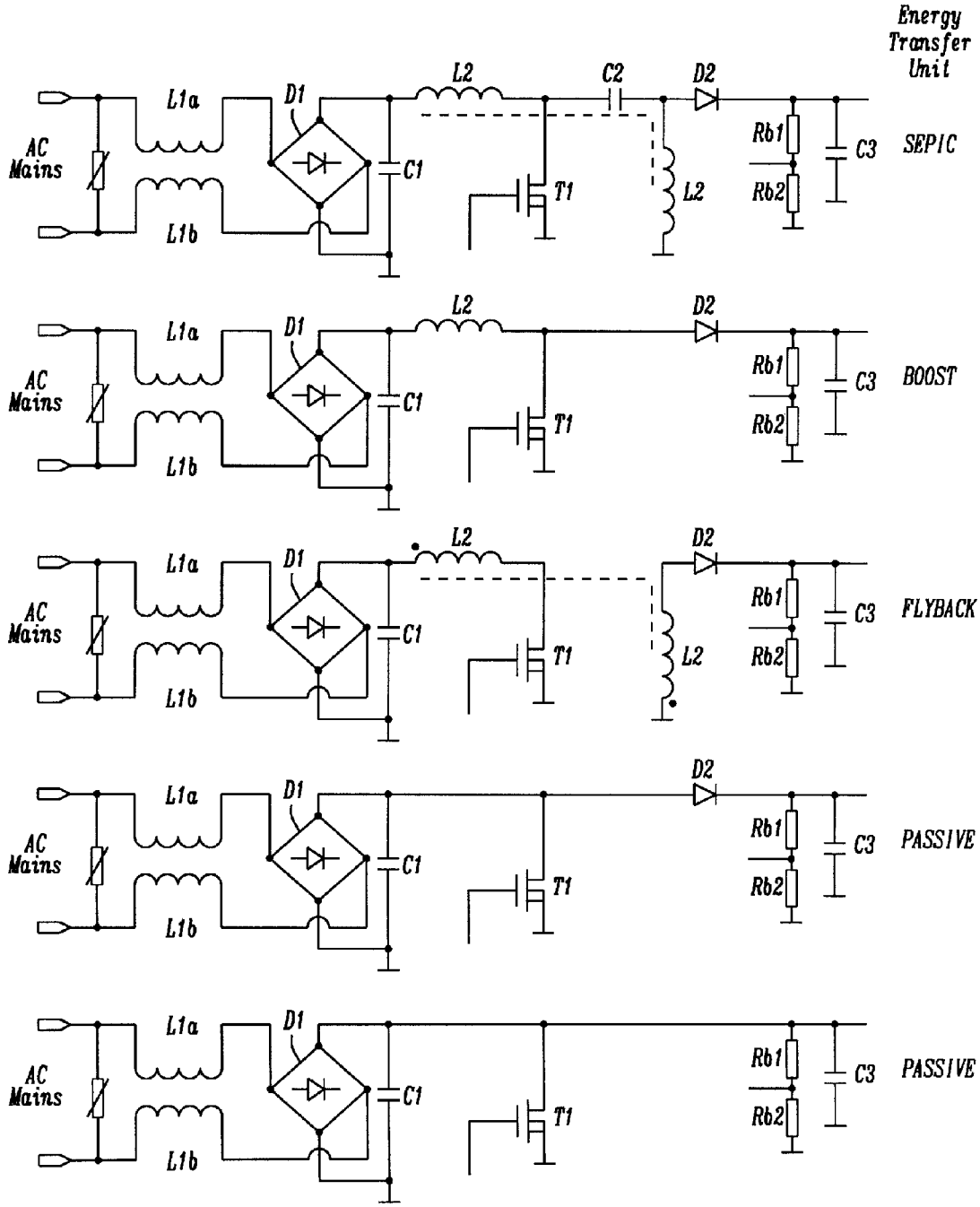
FIG. 4 illustrates circuit diagrams of example energy transfer units.

FIG. 4 shows circuit diagrams of example energy transfer units 132. The SSL driver unit 134 may comprise a switched mode or a linear power control topology e.g. flyback, buck, or linear current regulation.

Figure 5A:
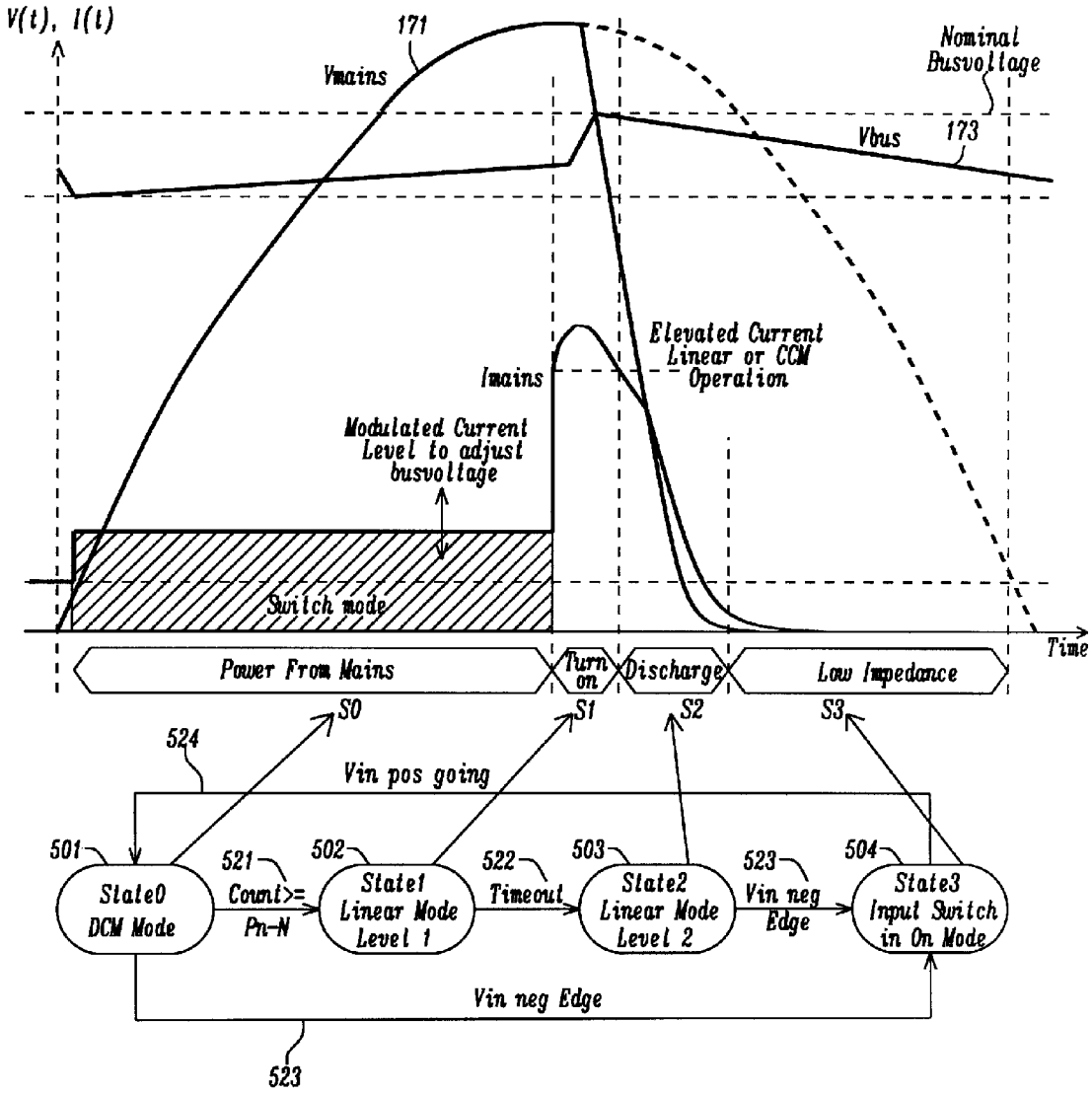
FIGS. 5*a* and 5*b* show example state sequences for different dimmer types.

FIG. 5*a* shows an example state sequence for a trailing edge dimmer 110. The state machine 158 moves between the states S0 501, S1 502, S2 503 and S3 504. In each state, the operating mode 185 for the energy transfer unit 132 is set as defined in the data 184 stored for this state (e.g. in the corresponding state information record 312) in the storage unit 159. The arrows 521, 522, 523, 524, 525 represent transition conditions. If a particular event is active in a given state and if the particular event occurs, then the transition into the subsequent state is executed.

In the illustrated example, the lighting assembly 120 remains in state S0 501 (operation in DCM) until the "estimated turn-on phase angle" has elapsed which causes a timeout event 521, 522. The timeout event 521, 522 causes the transition to the following state S1 502, S2 503. The state machine then waits for a Vin negative edge event 523 before moving into state S3 504. The Vin negative edge event 523 may be detect when the input voltage 171 or the rectified AC voltage 172 falls below a pre-determined low voltage threshold. From the state S3 504 a positive Vin edge event 524 leads back into state S0 501. The positive Vin edge event 524 may be detect when the input voltage 171 or the rectified AC voltage 172 reaches or crosses a pre-determined high voltage threshold. The state machine of FIG. 5*a* comprises a further transition 525 from state S0 501 to state S3 504 subject to the detection of a Vin negative edge event 523.

Vin edge events may be detected by the event generator 152 using digital representations of analogue signals, which are sensed in the power converter 130. In particular, the rectified AC voltage 172 may be used as a source of information.

In the state S0 501, the energy transfer unit 132 may be operated in a switch mode 185 in order to transfer energy from the input of the energy transfer unit 132 to the energy storage unit 133 at the output of the energy transfer unit 132. The effect of the energy transfer can be seen by the increase of the bus voltage Vbus 173. In the states S1 502, S2 503, the power switch 212 of the energy transfer unit 132 may be operated in a linear mode, such that the energy transfer unit 132 simulates a controlled load to the dimmer 110, thereby ensuring a reliable firing of the dimmer 110. In the state S3 504, the power switch 212 of the energy transfer unit 132 may be operated in a continuous on mode, in order to provide a low impedance to the dimmer 110.

Figure 5B:
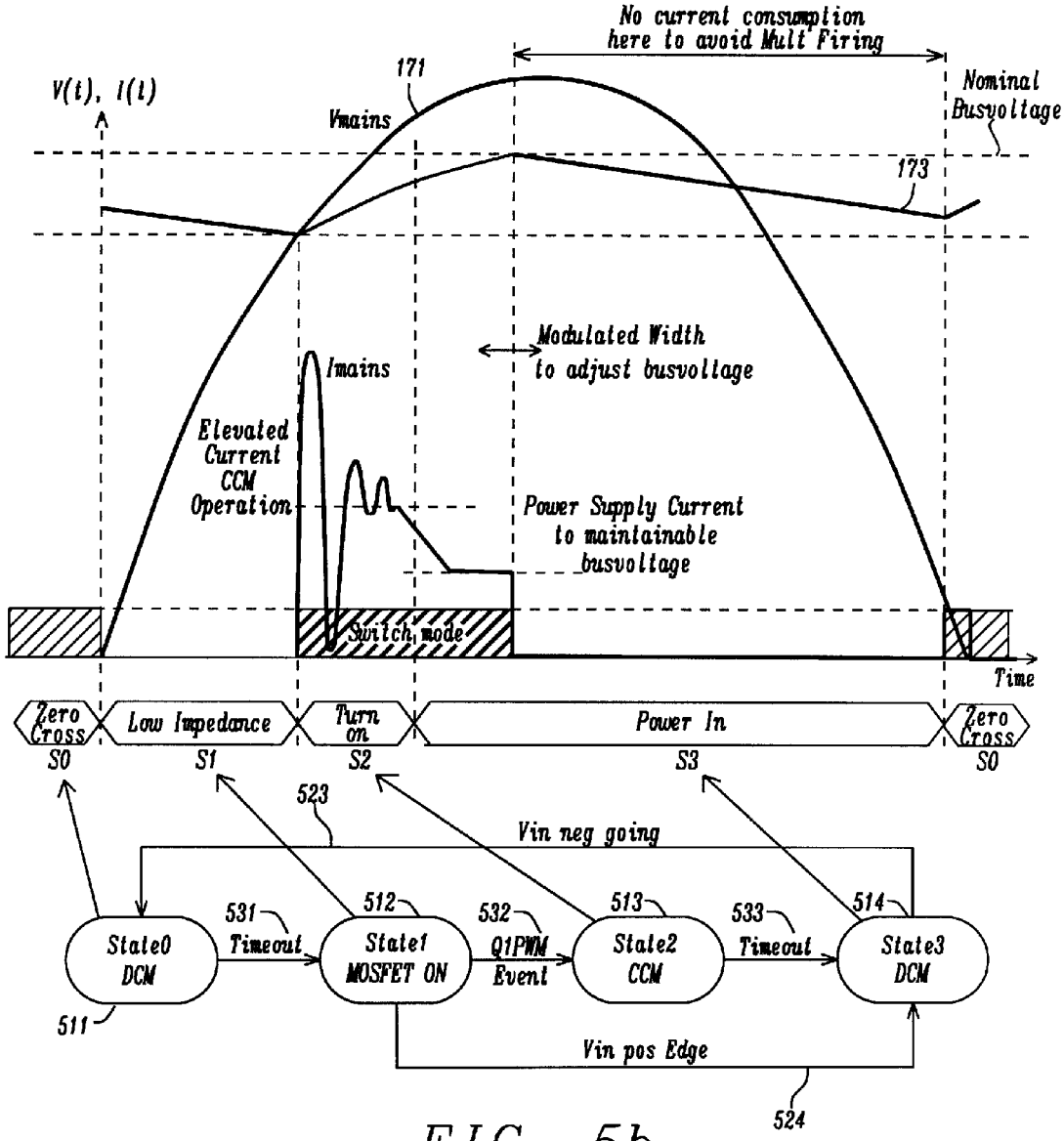

FIG. 5*b* shows an example state sequence for a leading edge dimmer 110. In this example the state sequence comprises four states S0 511, S1 512, S2 513 and S3 514. In state S1 511, the lighting assembly 120 is waiting for a switch mode event 532 indicating the turn on of the leading edge dimmer and then moves into state S2 513. State S2 513 remains active for a fixed time interval 533 before moving to state S3 514. From state S3 514 the state machine 158 changes into S0 511 at the next negative edge event 523 of Vin 171. A transition to state S1 512 may occur after a predetermine time interval 531. In states S0 511 and S3 514, the energy transfer unit 132 may be operated in a DCM mode, in state S2 513, the energy transfer unit 132 may be operated in a CCM mode, and in state S1 512, the power switch 212 of the energy transfer unit 132 may be operated in a continuous on mode.

A transition between the two state sequences may be triggered by the dimmer mode filter 157 which may continuously evaluate a suitable signal to extract the presence of a given dimmer type 187. In particular, a different dimmer type 187 may lead to the selection of a different dimmer mode table 311 which defines a different state sequence.

Figure 6:
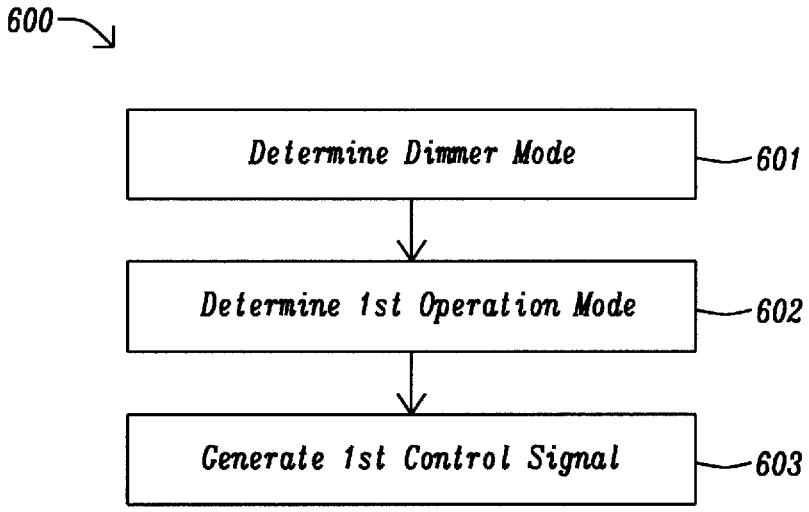
FIG. 6 shows a flow chart of an example method for controlling a power converter for an SSL device.

FIG. 6 describes a flow chart of an example method 600 for controlling a power converter 130. The power converter 130 may be configured to convert an input power 171 derived from a mains power supply into a drive power 175 for the light source 140. The method 600 comprises determining 601 a first dimmer mode 187 from a plurality of pre-determined dimmer modes 187, based on one or more sensor signals 181 sensed at corresponding one or more nodes of the power converter 130. The first dimmer mode 187 may be indicative of whether or not the input power 171 has been derived from the mains power supply using a dimmer 110, and optionally what type of dimmer has been applied to the mains power supply. Furthermore, the method 600 comprises determining 602 a first operation mode 185 of the power converter 130 based on pre-determined first state information 321. The pre-determined first state information 321 may be dependent on the first dimmer mode 187. For example, the first state information 321 may depend on the type of applied dimmer. In other words, different dimmer types may have individual state information and separate operation modes that are used by the proposed method to control the power converter. Furthermore, the method 600 comprises generating 603 a first control signal 186 for operating the power converter 130 in accordance to the first operation mode 185. Thus, the power converter 130 can be operated in an optimal way, depending on the applied dimmer type and a dedicated state machine for each dimmer type.

The method may comprise the optional step of selecting one of a plurality of dimmer mode tables 311 stored in a storage unit 159 for the corresponding plurality of pre-determined dimmer modes 187. A dimmer mode table 311 may provide state information for operating the power converter 130 in accordance to the corresponding operation mode. As such, a first dimmer mode table 311 may comprise a plurality of state information records 312. A state information record 312 is associated with the corresponding state and is indicative of one or more potential future states 301 and one or more events 183 which trigger a transition from the state to the one or more future states 301.

The method may comprise the optional steps of detecting the occurrence of an event 183, e.g. based on one or more sensor signals 181, and determining a subsequent state 301 from the one or more potential future states 301, based on the detected event 183. The subsequent state may also identify one of the plurality of state information records 312 comprising further state information 321, e.g. defining another operation mode 185 of the power converter 130. Typically, the another operation mode is different from the previous operation mode. The subsequent state may further provide a pointer to a storage location of the state information record 312 within the storage unit 159. In other words, the state information records may be indicative of pointers to the storage locations of the one or more state information records corresponding to the one or more future states. By doing this, an efficient means for storing a plurality of state machines within the storage unit is provided and an efficient method for processing the state information is available.

In the present document a control circuit 150 and a method have been described which allow adjusting the operation of a power converter 130 (e.g. of the energy transfer unit 132) by means of a state machine 158. The control circuit 150 allows different state sequences to be programmed for different dimmer types 187, thereby enabling a flexible and cost efficient adaption of an SSL based lighting assembly 120 to such different dimmer types 187. Furthermore, this allows improving the performance of SSL based lighting assemblies 120 in conjunction with dimmers 110.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A control circuit for a power converter; wherein the power converter is configured to convert an input power derived from a mains power supply into a drive power for a light source; wherein the control circuit comprises a dimmer mode detection unit configured to determine a dimmer mode from a plurality of pre-determined dimmer modes, based on one or more sensor signals indicative of a waveform of the AC voltage and sensed at corresponding one or more nodes of the power converter, the plurality of pre-determined dimmer modes indicating if and which type of dimmer has been applied to the mains power supply to derive the input power of the power converter;

a storage unit configured to store a plurality of dimmer mode tables for the plurality of pre-determined dimmer modes, the plurality of stored dimmer mode tables comprises one dimmer mode table for each dimmer mode, each dimmer mode table from the plurality of dimmer mode tables comprising a plurality of state information records defining a state machine for the respective dimmer mode, each state information record comprising pre-determined state information indicative of a state, an operation mode defining the operation of the power converter for the respective state, one or more future states, and one or more events which trigger a transition from the respective state to the one or more future states;

a state processor configured to determine a first state and a corresponding first operation mode of the power converter based on the state machine of the determined dimmer mode;

a first control unit configured to generate a first control signal for operating the power converter in accordance to the first operation mode; and an event detection unit configured to detect the occurrence of an event, based on the one or more sensor signals;

wherein during a cycle of the mains power supply, the state processor determines, based on the detected event, a second state from the one or more future states of the first state and a corresponding second operation mode; and the first control unit generates the first control signal in accordance to the second operation mode.

2. The control circuit of claim 1, wherein the plurality of pre-determined dimmer modes comprise one or more of:

a mode which indicates that the input power has been derived from the mains power supply without a dimmer;

a mode which indicates that the input power has been derived from the mains power supply using a leading edge phase-cut dimmer;

a mode which indicates that the input power has been derived from the mains power supply using a trailing edge phase-cut dimmer; and/or a mode which indicates that the input power has been derived from the mains power supply using an intelligent phase-cut dimmer.

3. The control circuit of claim 1, wherein the second state identifies a second of the plurality of state information records;

a second state information record comprises second state information defining a second operation mode of the power converter; and the second operation mode differs from the first operation mode.

4. The control circuit of claim 1, wherein the second state provides a pointer to a storage location of the second state information record within the storage unit.

5. The control circuit of claim 1, wherein said each state information record further comprises one or more of the following:

masking information which allows an event-triggered transition to be disabled; and/or timing information which specifies a time interval for an occurrence of a timeout event.

6. The control circuit of claim 1, wherein the input power is an AC power comprising an AC voltage and an AC current;

the one or more sensor signals comprise an input signal indicative of a waveform of the AC voltage; and the dimmer mode detection unit is configured to determine the first dimmer mode based on the input signal.

7. The control circuit of claim 1, wherein the power converter comprises an energy transfer unit configured to provide an intermediate power from the input power and an SSL device driver unit configured to provide the drive power from the intermediate power; and the first control signal is for controlling operation of the energy transfer unit.

8. The control circuit of claim 4, wherein the control circuit comprises a phase-cut angle detection unit configured to determine a dim level based on a phase-cut angle set by the dimmer; and a second control unit configured to generate a second control signal based on the dim level for operating the SSL device driver unit to provide the drive power in accordance to the determined dim level.

9. The control circuit of claim 4, wherein the energy transfer unit and the SSL device driver unit each comprise a switch mode power converter network comprising at least one power switch, such as a buck converter network, a buck-boost converter network, a SEPIC network, and/or a flyback network.

10. The control circuit of claim 6, wherein the control circuit is configured to operate a power switch of the energy transfer unit in a linear operation mode to determine the phase-cut angle set by the dimmer.

11. The control circuit of claim 4 wherein the first control unit is configured to generate the first control signal based on a sensor signal indicative of an intermediate voltage at an output of the energy transfer unit.

12. A method for controlling a power converter; wherein the power converter converts an input power derived from a mains power supply into a drive power for a light source; wherein the method comprises determining a dimmer mode from a plurality of pre-determined dimmer modes, based on one or more sensor signals indicative of a waveform of the AC voltage and sensed at corresponding one or more nodes of the power converter, the plurality of pre-determined dimmer modes indicating if and which type of dimmer has been a fled to the mains power supply to derive the input power of the power converter;

selecting, based on the determined dimmer mode, one of a plurality of stored dimmer mode tables, the plurality of stored dimmer mode tables comprises one dimmer mode table for each dimmer mode, each dimmer mode table from the plurality of dimmer mode tables comprising a plurality of state information records defining a state machine for the respective dimmer mode, each state information record comprising pre-determined state information indicative of a state, an operation mode defining the operation of the power converter for the respective state, one or more future states, and one or more events which trigger a transition from the respective state to the one or more future states;

determining a first state and a first operation mode of the power converter based on the state machine of the selected dimmer mode table;

generating a first control signal for operating the power converter in accordance to the first operation mode;

detecting the occurrence of an event based on the one or more sensor signals; and during a cycle of the mains power supply, determining, based on the detected event, a second state from the one or more future states of the first state and a corresponding second operation mode; and generating the first control signal in accordance to the second operation mode.

13. The method for controlling a power converter of claim 12, wherein the plurality of pre-determined dimmer modes comprise one or more of:

a mode which indicates that the input power has been derived from the mains power supply without a dimmer;

a mode which indicates that the input power has been derived from the mains power supply using a leading edge phase-cut dimmer;

a mode which indicates that the input power has been derived from the mains power supply using a trailing edge phase-cut dimmer; and/or a mode which indicates that the input power has been derived from the mains power supply using an intelligent phase-cut dimmer.

14. The method for controlling a power converter of claim 12, wherein the plurality of dimmer mode tables for the corresponding plurality of pre-determined dimmer modes are stored in a storage unit; and a first dimmer mode table from the plurality of dimmer mode tables, which corresponds to the determined dimmer mode, is indicative of the first state information for operating the power converter in accordance to the first operation mode.

15. The method for controlling a power converter of claim 12, wherein the second state identifies a second of the plurality of state information records;

a second state information record comprises second state information defining a second operation mode of the power converter; and the second operation mode differs from the first operation mode.

16. The method for controlling a power converter of claim 15, wherein the second state provides a pointer to a storage location of the second state information record within the storage unit.

17. The method for controlling a power converter of claim 12, wherein said each state information record further comprises one or more of the following:

masking information which allows an event-triggered transition to be disabled; and/or timing information which specifies a time interval for an occurrence of a timeout event.

18. The method for controlling a power converter of claim 12 wherein the input power is an AC power comprising an AC voltage and an AC current;

the one or more sensor signals comprise an input signal indicative of a waveform of the AC voltage; and the dimmer mode detection unit determines the first dimmer mode based on the input signal.

19. The method for controlling a power converter of claim 12, wherein the power converter comprises an energy transfer unit provides an intermediate power from the input power and an SSL device driver unit provides the drive power from the intermediate power; and the first control signal is for controlling operation of the energy transfer unit.

20. The method for controlling a power converter of claim 19, wherein a phase-cut angle detection unit determines a dim level based on a phase-cut angle set by the dimmer; and a second control unit generates a second control signal based on the dim level for operating the SSL device driver unit to provide the drive power in accordance to the determined dim level.

21. The method for controlling a power converter of claim 19, wherein the energy transfer unit and the SSL device driver unit each comprise a switch mode power converter network comprising at least one power switch, such as a buck converter network, a buck-boost converter network, a SEPIC network, and/or a flyback network.

22. The method for controlling a power converter of claim 21, wherein a power switch of the energy transfer unit is operated in a linear operation mode to determine the phase-cut angle set by the dimmer.

23. The method for controlling a power converter of claim 19, wherein the first control signal is generated based on a sensor signal indicative of an intermediate voltage at an output of the energy transfer unit.

* * * * *